United States Patent [19]

McQueen

[11] 4,344,351

[45] Aug. 17, 1982

[54] TRIGGER MECHANISM PROVIDING A SHORT BURST OF FIRE CAPABILITY FOR SUBMACHINE GUNS

[76] Inventor: Sidney J. McQueen, 414 Coors Rd. SW., Albuquerque, N. Mex. 87105

[21] Appl. No.: 230,740

[22] Filed: Feb. 2, 1981

[51] Int. Cl.[3] ..... F41D 11/02; F41D 11/10

[52] U.S. Cl. ..... 89/129 B; 89/140; 42/69 R

[58] Field of Search ..... 42/69 A; 89/129 B, 140, 89/144

[56] References Cited

FOREIGN PATENT DOCUMENTS 504569 7/1951 Belgium ..... 89/140

502942 10/1951 Belgium ..... 42/69 A

*Primary Examiner*—Stephen C. Bentley

*Attorney, Agent, or Firm*—Walter R. Keller

[57] ABSTRACT

A trigger mechanism for submachine guns and other automatic weapons, having a spring loaded burst finger incorporated into a standard trigger, so that the burst finger bears against the sear in such a way that when the trigger is squeezed the burst finger bears against the sear, turning the sear, and disengaging the sear from the bolt and the trigger to automatically overtravel, blocking the sear from re-engaging the bolt. Trigger rebound repositions the trigger allowing the sear to re-engage the bolt after a short burst of rounds has been fired; then the firer consciously releases the trigger and the trigger returns to its non-firing position. Otherwise full and continued depression of the trigger compels the sear to remain disengaged from the bolt producing a fully automatic firing.

2 Claims, 1 Drawing Figure

TRIGGER MECHANISM PROVIDING A SHORT BURST OF FIRE CAPABILITY FOR SUBMACHINE GUNS

SUMMARY

Submachine guns all have a fully automatic mode of fire, and many have an additional single shot mode. Burst firing of a limited number of shots has been primarily managed by training the weapon firer to quickly cease firing after initiating firing in the automatic mode, or partially by the use of switch levers or combinations of complex mechanical mechanisms or both, heretofore in conjunction with a two step sear. Thus in the past, burst controlled firing of a submachine gun, has depended almost exclusively on the expertise and reflexes of the firer. It is therefore an objective of the invention to provide a means for controlling burst firing which reduces the required expertise, or training and which is less dependent on the firer's reflexes.

Some weapons have two or more modes of operation such as single shot and automatic. Usually these weapons provide a lever or button which the operator must relocate to switch from one mode to another. Other types which utilize progressive trigger pull provide either single shot and full automatic, while this invention provides primarily burst firing and full automatic mode. The former in times of combat or other stressful situations can result in the weapon being in the undesired mode at the time of firing. It is therefore an objective of the invention to provide a simple burst control mechanism which does not require a changing of levers, buttons, switches, etc., but requires only firer's basic knowledge of the weapon. Finally it is an objective of the invention to provide a reliable, yet inexpensive means to have a burst fire capability, in a submachine gun, with fewer moving parts than prior art.

BACKGROUND OF THE INVENTION

1. Field of the Invention

This invention relates generally to automatic weapons and more particularly to submachine guns, machine pistols, and automatic rifles.

2. Description of Prior Art

Most hand weapons which have a selection of modes of fire, provide a capability of automatic fire where the sear is held disengaged for fully automatic fire, or the sear automatically engages the bolt after one round is fired, providing a single shot capability. No known weapon provides a burst, limited number of shots, capability, without the use of complex intricate delicate parts added to the basic design, or usage of above mentioned levers, buttons, or both except that which is obtained from a firer's capability to quickly cease automatic firing. Consequently, the burst firing capability of many weapons, depends mainly on the expertise and reflexes of the firer.

DESCRIPTION OF THE PREFERRED EMBODIMENT

Figure 1:
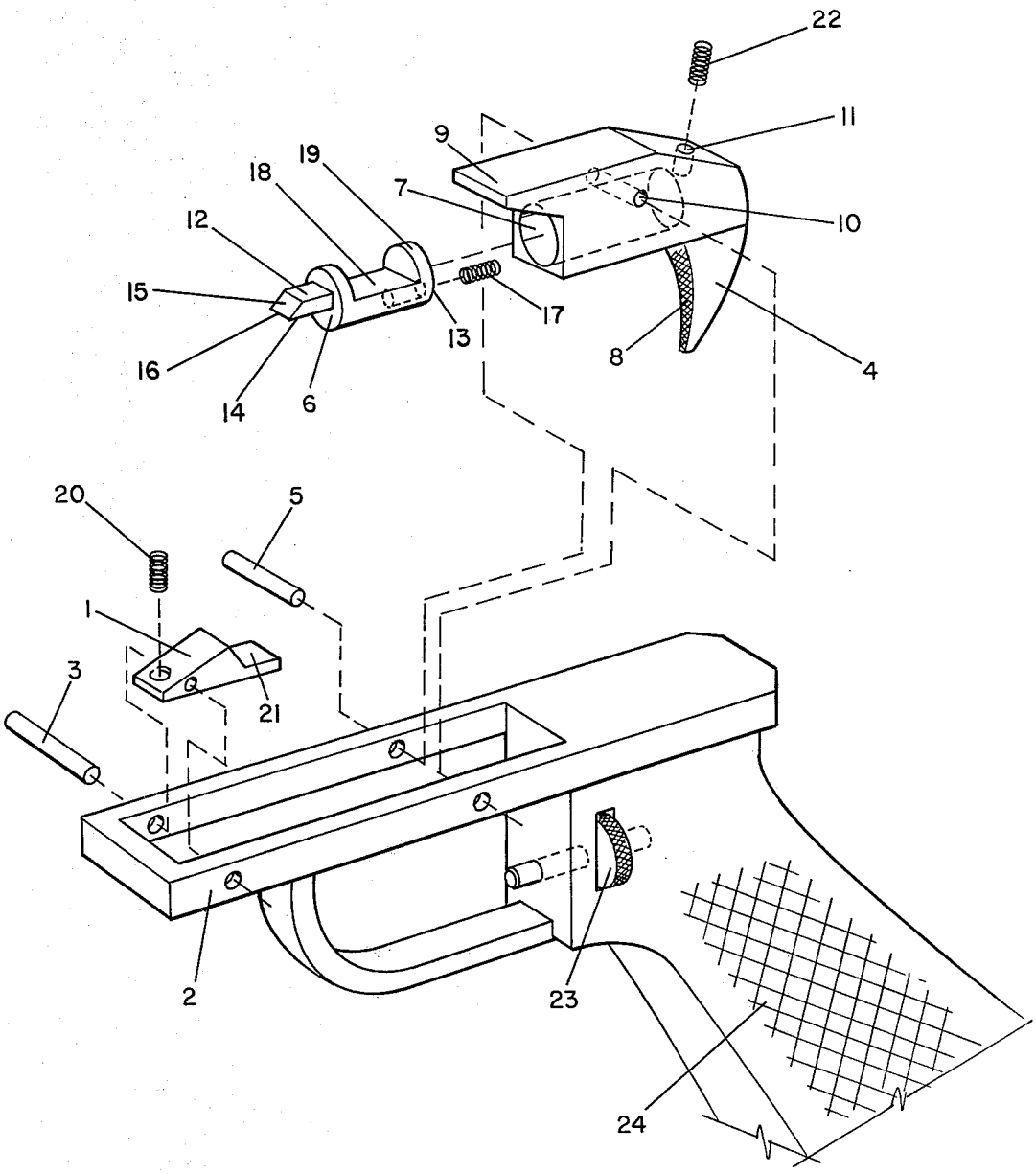
FIG. 1 is an exploded isometric view of the invention.

FIG. 1 shows a standard type sear 1 pivotally mounted in a trigger frame 2 by a pivot pin 3, and a trigger 4 pivotally mounted in the trigger frame 2 by a trigger pin 5. FIG. 1 also shows that a burst finger 6 is slideably installed in a finger bore 7 in the trigger 4. The trigger 4 is generally L shaped having a finger lever 8 and a full automatic sear lever 9 and pivot hole 10. The trigger 4 has a hole bored therein adjacent to the full automatic sear lever 9 and essentially parallel to the full automatic sear lever 9, and transverse to and intersecting the pivot hole 10, said hole is designated the finger bore 7. A smaller hole is drilled into the trigger 4 from the top down into the finger lever 8 and is designated a spring hole 11. The burst finger 6 generally made out of cylindrical stock sized to slideably but snuggly insert into the finger bore 7. The burst finger 6 has a sear tip 12 and a butt end 13. The sear tip 12 is shaped to have a lower diametrical longitudinal flat surface 14 which intersects a beveled upper surface 15, thus forming a relatively sharp edge 16. The butt end 13 is a smooth surface perpendicular to the longitudinal axis of the cylindrical stock. Inserted into the lower portion of the butt end 13 is a biasing spring 17, shown as a helical spring. The biasing spring 17 bears against the bottom of finger bore 7. From adjacent to the butt end 13 toward the sear tip 12 the upper portion of the body of the burst finger 6 is removed to form a longitudinal cavity 18 which permits the burst finger 6 to slide in the finger bore 7, yet leaving a lip 19 adjacent to the butt end 13 of the burst finger 6 which engages the trigger pin 5 retaining the burst finger 6 inside the trigger 4.

As shown in FIG. 1 the sear 1 is biased toward the position in which it engages the bolt, not shown, by a sear spring 20. As the firer's finger presses against the finger lever 8 of the trigger 4, the full automatic sear lever 9 is rotated, as is the burst finger 6 therein, and the lower flat surface 14 presses on and forces a trigger tang 21 on the sear 1 to rotate about the sear pin 3 thereby disengaging the sear 1 from the bolt. However, because the burst finger 6 does not extend toward the sear 1 as far as does the full automatic sear lever 9, the burst finger 6 disengages from the trigger tang 21 on the sear 1; the sear 1 being biased, tends toward the position whereby it could normally engage the bolt. However, after the burst finger 6 disengages from the trigger tang 21, the trigger 4 continues a slight over travel, because of the release of resistance from the sear 1. During, the slight overtravel, the sear lever 9 because of its close proximity, in dimensions as well as design, to the burst finger 6, blocks the sear 1 from immediately returning and engaging the bolt. This permits approximately three rounds to be fired because of the time it takes the firer's finger to automatically rebound without conscious thought or effort, after the over travel, to the position the firer intended for a burst. This is not reflex on the part of the firer, but time and distance involved in the finger automatically rebounding. The conscious return of the trigger finger by the firer to the initial non-firing position releases the trigger 4 and allows the sear 1 to re-engage the bolt. The burst finger 6 is forced into the trigger 4 by the end of the trigger tang 21 as the sear 1 moves towards engaging the bolt. However, the trigger 4 is also biased, by a return spring 22 installed in spring hole 11, to return to the non-firing position. Upon the firer releases the trigger 4, the sear 1 re-engages the bolt and the burst finger 6 again is above and bears on the trigger tang 21.

If the firer desires continued automatic fire instead of a burst, after the burst finger 6 disengages from the trigger tang 21, the finger lever 8 is further pressed thus forcing the sear lever 9 against the trigger tang 21 forcing the sear 1 to remain disengaged from the bolt.

FIG. 1 shows a stop screw 23, adjustably mounted in a threaded hole in the trigger frame 2 adjacent to a pistol grip 24. The stop screw 23 is optional and limits trigger 4 travel for single shot in training or tactical use.

The number of rounds fired in a burst with the above invention is a function of the rate of fire of the weapon; and the dimensional relationship between the sear 1 and the sear tip 12, which determines the travel of the sear 1 to re-engage the bolt. It has been found however, that for any particular given design, a firer's expertise or reflexes have little or nothing to do with controlling the number of rounds in a burst. That is to say an inexperienced person with relatively slow reflexes can fire the designed burst practically as well as an experienced, quick reacting firer.

I claim:

1. A trigger mechanism providing a burst capability in automatic weapons comprising:

a trigger pivotally mounted in a trigger frame, said trigger having a sear lever, a finger lever, and a transverse pivot hole; and said trigger having a finger bore essentially parallel to and adjacent to the sear lever, said finger bore intersecting the pivot hole; and said trigger having a spring hole extending from the top of the trigger down into the finger lever; and a burst finger sized to slideably fit the finger bore; said burst finger having a sear tip which has a lower flat surface, and a beveled upper surface, forming a relatively sharp edge at the sear tip; and said burst finger having a butt end; and said burst finger having a longitudinal cavity in the upper portion of the body of the burst finger, adjacent to the butt end, said longitudinal cavity being sized to slideably permit a trigger pin to be installed in the transverse pivot hole; and a sear being pivotally mounted in the trigger frame, said sear having a trigger tang; and a biasing spring installed in the burst finger said biasing spring bearing on the bottom of the finger bore, and said burst finger extending toward the trigger tang on the sear sufficiently to engage said trigger tang on the sear, and a return spring installed in the spring hole said return spring biasing the trigger to return to the non-firing position.

2. The invention of claim 1 wherein a stop screw is adjustably mounted in the trigger frame adjacent to a pistol grip to limit travel of the trigger.

* * * * *